US006032554A

United States Patent [19]

Durant

[11] Patent Number: 6,032,554

[45] Date of Patent: Mar. 7, 2000

[54] VALVE PACKING EXTRACTOR AND VALVE GLAND CLEANER

[76] Inventor: Raymond J. Durant, Box 324, Andrew, Alberta, Canada, T0B 0C0

[21] Appl. No.: 09/203,589

[22] Filed: Dec. 2, 1998

Related U.S. Application Data

[62] Division of application No. 08/901,742, Jul. 28, 1997, Pat. No. 5,884,536.

[30] Foreign Application Priority Data

Feb. 27, 1997 [CA] Canada ..... 2198664

[51] Int. Cl.[7] ..... B25B 33/00

[52] U.S. Cl. ..... 81/8.1; 29/259; 29/264

[58] Field of Search ..... 81/8.1, 3.05, 3.48; 29/256, 258–260, 263–265, 278, 213.1

[56] References Cited

U.S. PATENT DOCUMENTS

| | | | |
|---|---|---|---|
| 1,165,041 | 12/1915 | Toon, Sr. . | |
| 1,635,743 | 7/1927 | Davenport . | |
| 2,401,043 | 5/1946 | Bowman et al. | 81/8.1 |
| 2,822,713 | 2/1958 | Schmidt | 81/8.1 |
| 3,149,514 | 9/1964 | Shaub | 81/8.1 |
| 3,443,460 | 5/1969 | Johnston | 81/8.1 |
| 3,651,717 | 3/1972 | Johnston, Jr. | 81/8.1 |
| 3,727,293 | 4/1973 | Phillips, Sr. . | |
| 4,509,392 | 4/1985 | Smith | 81/8.1 |
| 5,253,405 | 10/1993 | Carroll | 29/213.1 |
| 5,375,484 | 12/1994 | Castelletti | 81/8.1 |
| 5,408,901 | 4/1995 | Bishop | 81/8.1 |

FOREIGN PATENT DOCUMENTS

| | | |
|---|---|---|
| 1170242 | 7/1984 | Canada . |
| 217 730 | 1/1985 | Germany . |
| 9231 | 2/1914 | United Kingdom . |

*Primary Examiner*—D. S. Meislin
*Attorney, Agent, or Firm*—Jones, Tullar & Cooper PC

[57] ABSTRACT

An apparatus for quickly and efficiently removing valve packing from a valve of the type having a threaded or non-threaded valve stem. In general, the apparatus includes a sleeve adapted to be positioned about the portion of the valve stem which extends exteriorly of the packing. The sleeve is rotatably connected to a translation mechanism operable in conjunction with the exposed portion of the valve stem. Depending on the type of valve and whether the exposed portion of the valve stem is threaded or smooth and whether or not the valve stem is capable of rotation, the translation mechanism can either be threadingly mated or clamped onto the valve stem to cooperate therewith for translating the sleeve toward or away form the packing. When the translation mechanism is operated, the rotatably connected sleeve is caused to translate along the valve stem. A plurality of curved teeth depend from the sleeve in such a manner that they all curve in the same rotational direction with respect to the sleeve. When the sleeve is rotated in that rotational direction and a downward force on the sleeve is applied by operating the translating mechanism, the teeth are forced to penetrate down and into the packing material. Once embedded, the translation mechanism can be operated in the opposite direction to apply an axial removal force to the sleeve and, hence, the teeth, thereby extracting the valve packing in which the teeth are embedded. Advantageously, since the sleeve is rotatable independently of the translation mechanism, the rotational force on the sleeve can be maintained or furthered to ensure the teeth remain embedded in the valve packing and to provide relative twisting motion between the valve packing and valve packing housing to facilitate removal of the valve packing. The teeth are readily removable and replaceable with different teeth or other implements for performing a variety of functions relating to removal of the valve packing, such as cutting, chiselling gouging, cleaning and polishing.

34 Claims, 11 Drawing Sheets

Fig. 7A
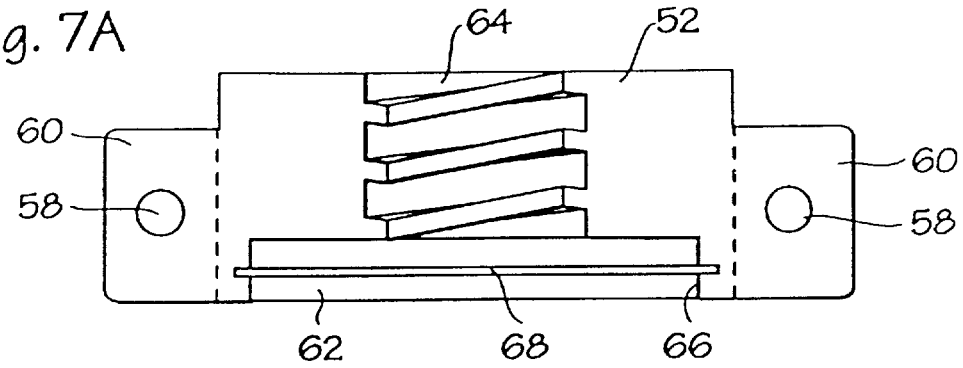
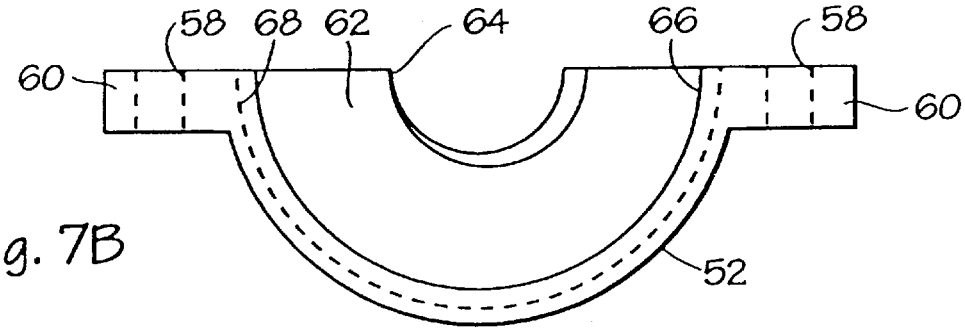
Fig. 7B
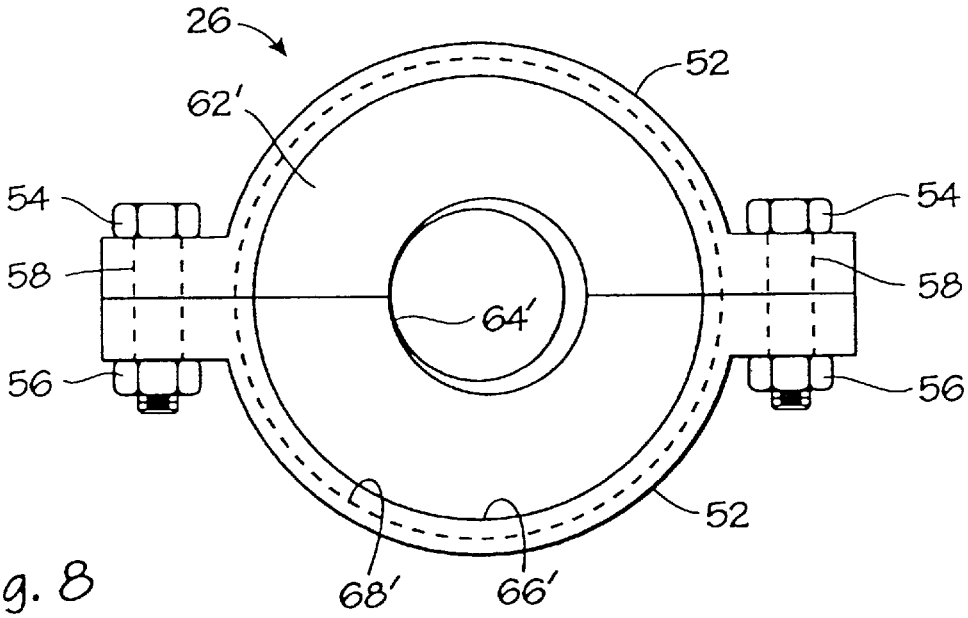
Fig. 8

VALVE PACKING EXTRACTOR AND VALVE GLAND CLEANER

This application is a divisional of application Ser. No. 08/901,742, filed Jul. 28, 1997 now U.S. Pat. No. 5,884,536.

This invention relates to the process of removing valve packings from their housings, and more particularly, to an apparatus capable of efficiently removing various types of valve packings in a wide range of conditions and for cleaning the valve gland once the packing has been removed.

Valve packings usually consists of one or more concentric rings which are fitted and compressed into the valve housing around the valve stem. Over time, valve packings deteriorate and must be removed and replaced. Typically, at the time replacement is necessary, the packing has become brittle and compressed making removal difficult.

Solutions proposed thus far involve a variety of scrapers, picks, chisels, and corkscrews or various devices based thereon. For the most part, the use of such devices is laborious in nature and there is a possibility of damage to valve stem, housing and related parts of the valve. Such devices also tend to leave debris and other particles behind which, if not removed completely, can result in damage to the valve or improper seating of the fresh packing rings.

U.S. Pat. No. 1,635,743 describes an apparatus for removing piston packings comprising a split cylinder provided with a number of hooks at its lower end. The cylinder is adapted to be positioned about the piston rod with the hooks in contact with the upper packing ring. The hooks are designed such that when the cylinder is turned with downward pressure thereon, the hooks embed in packing. A hand lever is then used to engage the cylinder and extract the packing engaged on the hooks. The problem with this device is that since the extraction force is directed entirely axially with respect to the piston and/or packing rings, there is a tendency for the hooks to tear out of the packing material when the packing does not give way easily. The damage created thereby often prevents the device from being used more than once to remove a stubborn packing.

In general, there are two main valve stem arrangements used in industry. The first, as exemplified in FIG. 1, will be referred to herein as a "rising handle" arrangement. In this arrangement, the valve wheel or handle A is attached directly to the valve stem B. The valve stem B has a threaded portion C which extends through a matingly threaded valve yoke D. Rotation of the handle A causes the valve stem B to rotate and, thus, translate axially through yoke D. Since the handle A is attached directly to the valve stem B, translation of the valve stem B causes the valve handle to fall or rise, depending on the direction of rotation of the handle A, hence the name "rising handle". The second category of valve stem arrangements is exemplified in FIG. 2, which will be referred to herein as a "rising stem" arrangement. In this case, the threaded portion C' of the valve stem B' extends through a matingly threaded member E'. The threaded member is disposed in yoke D' for free rotation with respect thereto and is connected directly to the valve handle A'. Rotation of the valve handle A' results in the valve stem B' rising or falling, hence the name. In both the rising handle and the rising stem arrangements, the valve stem translates up and down, however, the valve stem also rotates in the rising handle arrangement whereas in the rising stem arrangement, it does not. Consideration of these differences must be had if a universally applicable valve packing removal instrument is to be contemplated.

U.S. Pat. No. 5,375,484 discloses a valve packing removal tool having a downwardly angled extractor blade extending from a leg that depends from an annular body which is adapted to be affixed to the valve stem of a valve. Through its rotation, the valve stem is used to precisely control the path of the extractor blade. Therefore, it is not possible to control the downward rate of penetration and rate of rotation independent of one another. In addition, this device is operable only with rising handle type arrangements since its operability depends upon rotation of the valve stem.

The present invention provides a valve packing extractor which is effective in most applications for removing valve packings in a wide variety of conditions and, in many cases, in one piece without having to resort to more destructive methods. The present invention does not require disassembly of the valve nor does it, in the case of rising handle valve stem arrangements with an engageable threaded portion, require depressurizing or flushing of the lines. The present invention not only can be used to quickly and efficiently remove valve packings, but it is readily adaptable to be used as a packing gland or housing cleaner.

Accordingly, there is provided in a first aspect of the invention, an apparatus for removing a valve packing from around a valve stem of a valve which comprises a split sleeve adapted to be positioned generally concentrically about the valve stem. The split sleeve is rotatably connected to a collar for free rotation with respect thereto. The split sleeve has a plurality of packing engagement teeth disposed on its end proximal the valve packing. The collar is adapted to be positioned on the valve stem and is translatable toward or away from the packing either with or with respect to the valve stem. A rotational force is applied to the sleeve for rotating the split sleeve while the collar is being translated in a first direction toward the packing to enable the teeth to engage the packing, and the rotational force is maintained or furthered while the collar is being translated in a second direction opposite said first direction to remove the valve packing or a portion thereof.

Thus, in the case of either a rising stem or rising handle type arrangement, if the valve stem has a threaded portion of sufficient length to permit engagement of the collar and to permit sufficient operational translation of the collar, the collar can be provided with an internal threading such that when the collar is disposed on the threaded portion of the valve stem, the collar itself can be rotated to provided the necessary translation for operation of the apparatus. In such a case, since neither the valve handle nor the valve stem be moved, removal of the packing can occur while the valve is online and, without necessarily having to depressurize or flush the lines. Where there is insufficient threading, the collar can be clamped directly to the valve stem and the valve handle can be used to effect its translation. In either case, the split sleeve is rotatable independently of the collar, regardless of whether the collar rotates or not.

According to another aspect of this invention, an apparatus is provided for removing a valve packing from around a valve stem of a valve in which a portion of the valve stem which extends exteriorly of the valve packing is threaded. The apparatus comprises a split sleeve adapted to be positioned generally concentrically about the exterior portion of the valve stem. The split sleeve is rotatably connected to a collar which is engageable with the threaded portion of the valve stem and is axially translatable with respect to the valve stem by rotation of the collar. The split sleeve has disposed on its end proximal the valve packing a plurality of pointed teeth curved in the same rotational direction. Means for applying a rotational force to the sleeve for rotating the split sleeve in the same rotational direction, while the collar is being translated in a direction towards the valve packing, is provided to enable the teeth to penetrate the valve packing, and to maintain or further the rotational force on the sleeve while the collar is being translated in the opposite direction to remove the valve packing or a portion thereof.

In general, the sleeve in which the extracting teeth are housed is permitted to be rotated independently of the collar which is used to apply the axial forces for tooth penetration and packing ring extraction. This allows the packing ring to be rotated while being pulled axially which makes for an easier extraction and one which is less prone to breaking, tearing or otherwise damaging the packing to a state which requires cruder methods (i.e. chiselling, scraping, picking, etc.) for its removal.

The teeth are easily removable and, therefore, can be readily exchanged with alternate teeth to suit the condition of the packing or with other implements to enable the performance of different functions such as scraping and cleaning, in the event these functions are necessary. The number of teeth, preferably about six, distribute the extraction forces about the packing ring and reduce the local stresses at the points of engagement, thus increasing the probability of removal of the packing ring or rings as whole elements.

Accordingly, there is provided in an alternate embodiment of the invention a valve packing removal and cleaning apparatus for removal of a valve packing from inside a valve packing housing and around a valve stem of a valve and for cleaning of the valve packing housing. The valve stem extends exteriorly of the valve packing housing and has at least a portion thereof being threaded. The valve packing removal and cleaning apparatus comprises axial translation means threadingly engageable with the threaded portion of the valve stem. A sleeve is provided that is adapted to be disposed generally concentrically about the valve stem. The sleeve is rotatably connected to the axial translation means for independent rotation with respect thereto, and the axial translation means is selectively rotatable to cause the axial translation means and, thereby, the sleeve to be selectively translated in relation to the valve stem. Means are provided for connecting to the sleeve proximal the valve packing housing a plurality of valve packing engagement teeth, valve packing cutting implements or valve packing housing cleaning implements, depending on the need. Means are also provided for selectively rotating the sleeve with or without selectively rotating the axial translation means.

In yet another aspect of the invention, there is provided a valve packing extracting apparatus for removing valve packing from a valve, wherein the valve packing is disposed generally within a valve packing housing through which a valve stem extends. The valve stem has a portion extending exteriorly of the packing and the valve packing housing, of which at least a portion thereof is threaded. The valve packing extracting apparatus comprises a sleeve adapted to be positioned about the valve stem. The apparatus further includes translation means adapted to engage the threaded portion of the valve stem for axial translation along the threaded portion when the translation means is rotated about the valve stem. The sleeve is rotatably connected to the translation means and is independently rotatable with respect thereto. A plurality of curved teeth are connectable to the sleeve and depend from the sleeve end proximal to the valve packing, such that they curve in the same rotational direction. When the sleeve is rotated in the same rotational direction in which the teeth point while being translated in a first axial direction toward the valve packing by rotation of the translation means, the teeth are caused to penetrate and embed into the packing. When the translation means is rotated in the opposite direction to cause the sleeve to be translated in an axial direction opposite the first axial direction, the valve packing in which said teeth are embedded is pulled out of the valve packing housing.

Because the apparatus in this case, and in particular, the collar or translation means, operates on the threaded portion of the valve stem, the valve packing can be removed with the valve online, without having to depressurize or flush the conduits to which the valve is attached. The use of a split sleeve allows the device to be installed on a valve stem, without having to spend time in removing the valve handle. The interchangeability and variety of teeth and related implements permits the apparatus to be used in a variety of applications and with different valve packings in various conditions.

These and other features and advantages of the present invention are described hereinbelow in conjunction with the accompanying drawings.

BRIEF DESCRIPTION OF THE DRAWINGS

FIG. 7A is an elevational view of a half of the collar portion of the apparatus; and FIG. 7B is a bottom end view of the collar half;

FIG. 8 is a bottom view of the joined collar halves;

DETAILED DESCRIPTION OF THE INVENTION

Figure 1:
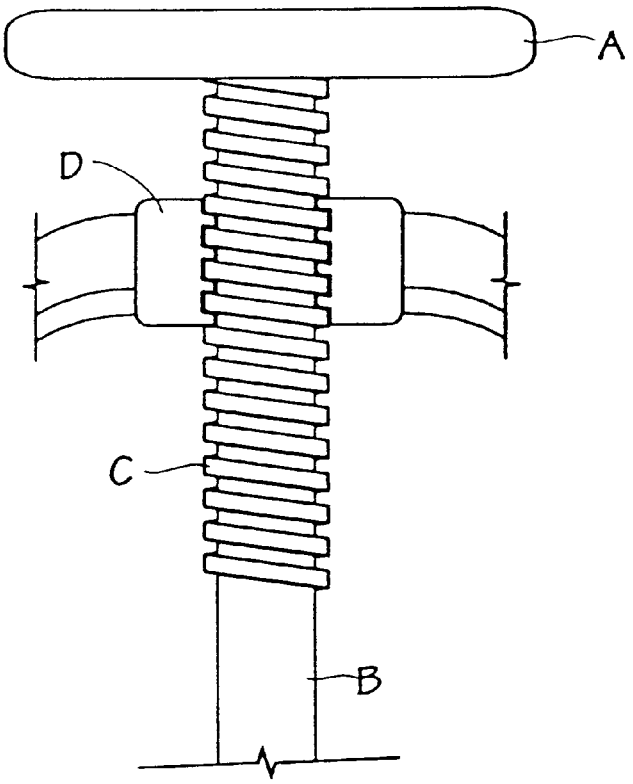
FIG. 1 is a cross-sectional view of the upper portion of a valve exemplifying a typical rising handle valve stem arrangement.
Figure 2:
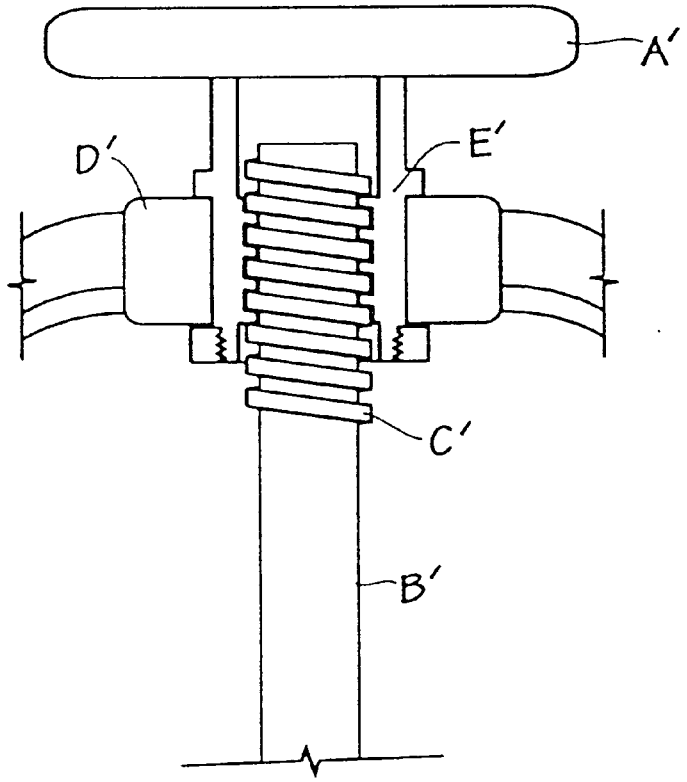
FIG. 2 is a cross-sectional view of the upper portion of a valve exemplifying a typical rising stem valve stem arrangement.
Figure 3:
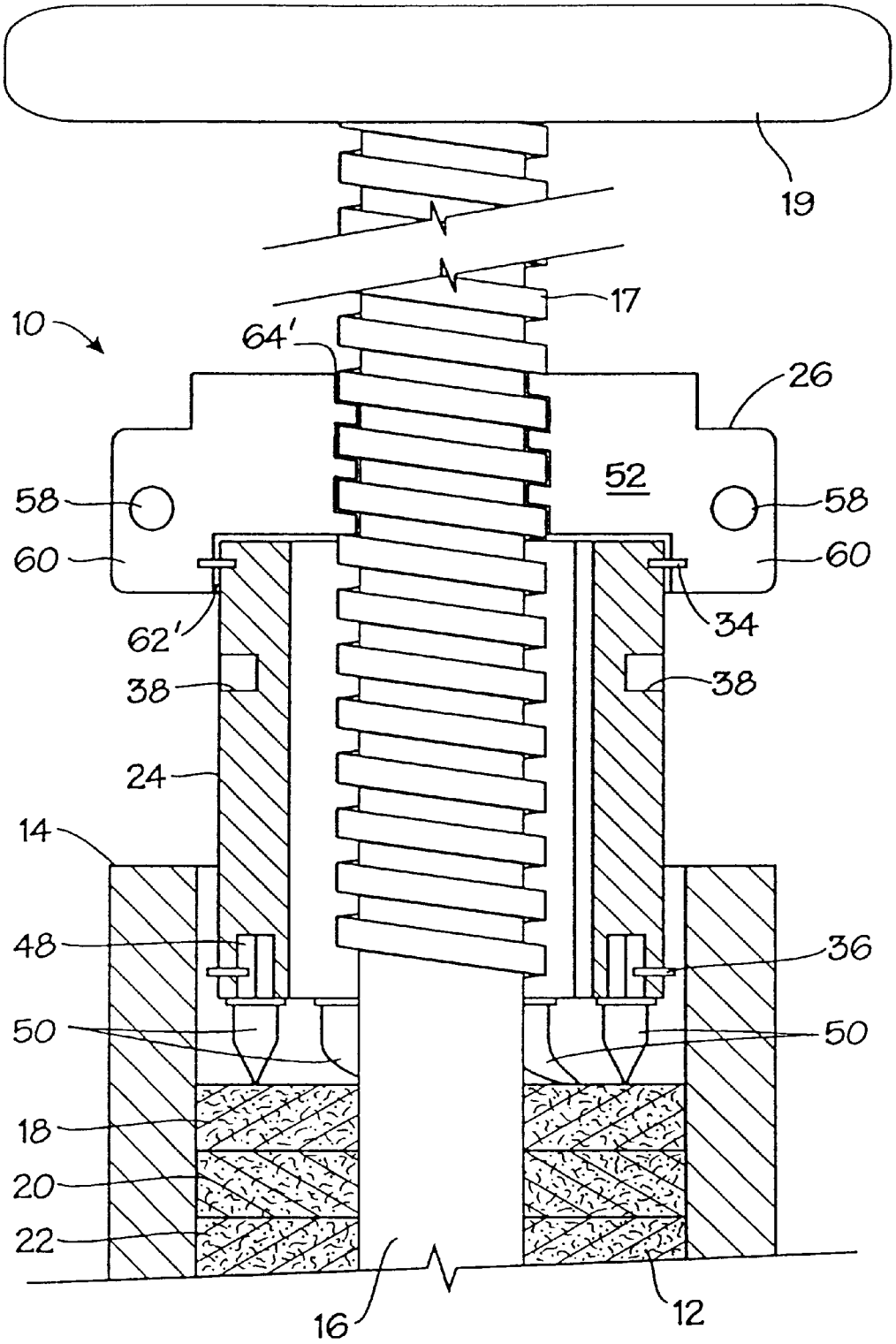
FIG. 3 is a cross-sectional elevation of the subject invention showing the sleeve and extractor collar in position for removal of a valve packing ring lodged in a valve housing about a valve stem. The front half of the collar has been removed for clarity.

The valve packing extractor is denoted generally by reference numeral 10 in FIG. 3. Valve packing 12 is shown compressed within the housing 14 and about a valve stem 16 whose upper portion 17 is threaded sufficiently to allow operable engagement of the extractor 10 thereon. A valve yoke (not shown in FIG. 3) typically engages the threaded portion below valve handle 19 such that when valve handle 19 is turned, the valve stem 16 translates axially for operation of the valve. The valve stem 16 may or may not rotate, depending on the type of valve arrangement as discussed above. The valve packing 12 typically comprises one or more rings of packing material and, in the valve illustrated in FIG. 3, three packing rings 18, 20, 22 are shown. The valve packing extractor 10 consists of a sleeve 24 which is adapted to be positioned generally concentrically about the valve stem 16 and at least partially within the housing 14 and a translation mechanism, namely a collar 26, which is engageable with the both the valve stem 16 and the sleeve 24. The collar 26 is engageable with the sleeve 24 in such a manner that the sleeve 24 is freely rotatable both with respect to the collar 26 and about the valve stem 16. The collar 26 is engageable with the threaded portion 17 of valve stem 16 for translation with respect to the packing 12.

Figure 4:
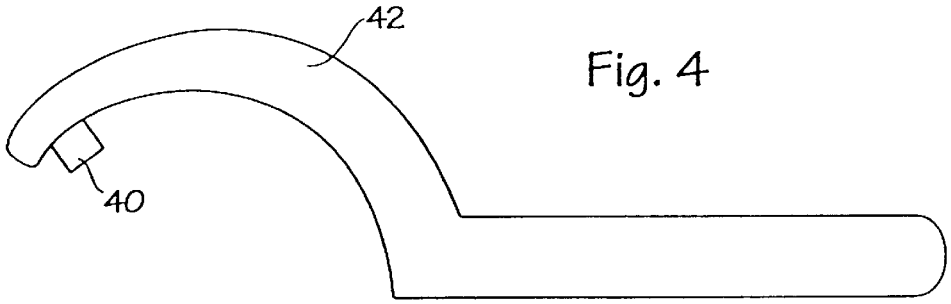
FIG. 4 is a plan view of a device, namely a wrench, which can be used for exerting a rotational force to the sleeve portion of the invention.
Figure 5A:
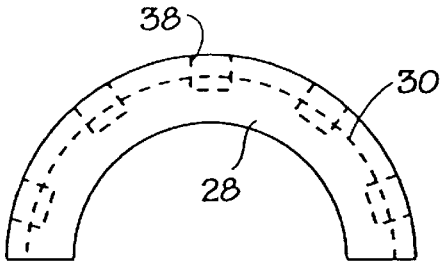
FIG. 5A is an top end view of one half of the split sleeve portion of the apparatus.
Figure 5B:
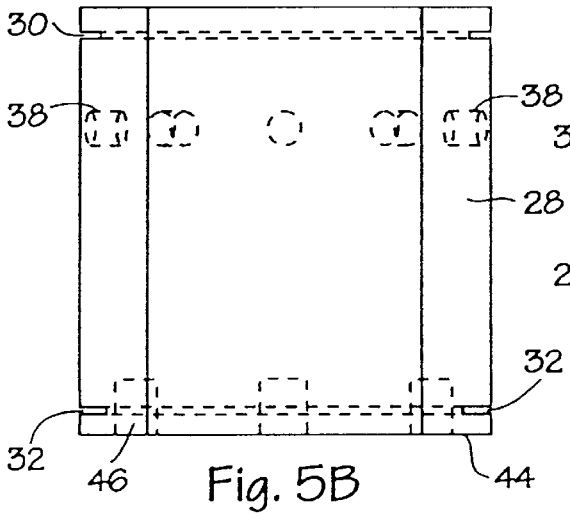
FIG. 5B is an elevation of the split sleeve half.
Figure 6:
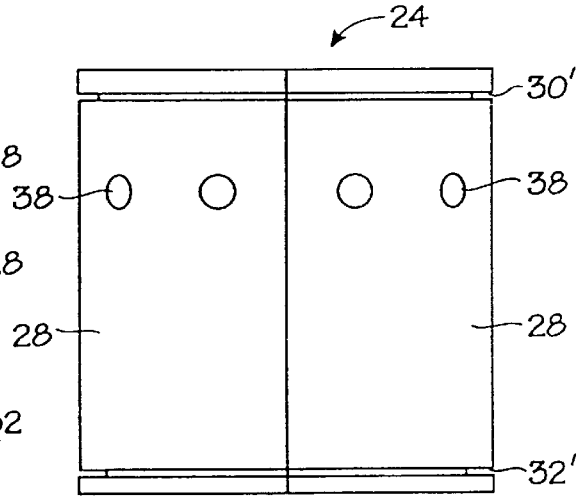
FIG. 6 is a side elevation of the two halves of the split sleeve, shown side-by-side.
Figure 5C:
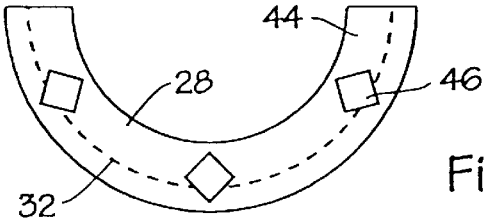
FIG. 5C is a bottom end view of the split sleeve half.
Figure 9:
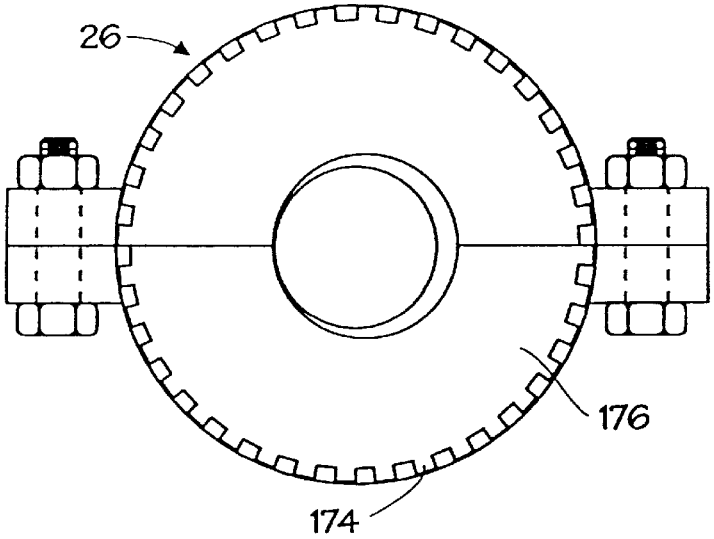
FIG. 9 is a top view of the joined collar halves.

In the preferred embodiment, the sleeve 24 comprises mating semi-cylindrical halves 28, shown in greater detail in FIGS. 5A–5C. Each sleeve half 28 is preferably provided with upper and lower semi-annular grooves 30, 32 which form annular grooves 30',32' when the sleeve halves 28 are mated to form the split sleeve 24 (see FIG. 6). The upper and lower annular grooves 30',32' are adapted to receive respective retaining rings 34, 36 whose purpose, in part, is to maintain the sleeve halves 28 in their mating split sleeve configuration (see FIG. 3). A plurality of holes 38 spaced radially about the circumference of the sleeve 24 are provided which are adapted to be engaged by lug 40 of wrench 42 (see FIG. 4) to enable a rotational force to be applied to the sleeve 24.

At the lower end 44 of each sleeve half 28, there is provided a series of square sockets 46, each of which is adapted to receive the shank 48 of a corresponding tooth 50 (see FIG. 3). Conveniently, the tooth shanks 48 are retained in their respective sockets 46 by the lower retaining ring 36. However, a slight interference fit or self-holding taper between the shank 48 and the socket 46 has been found useful to temporarily retain the shanks 48 in the sockets 46 before the lower retaining ring 36 can be installed during assembly of the extractor 10. The square cross-section of the sockets 46 and the shanks 48 prevents the teeth 50 from rotating relative to the socket 46.

Figure 10A:
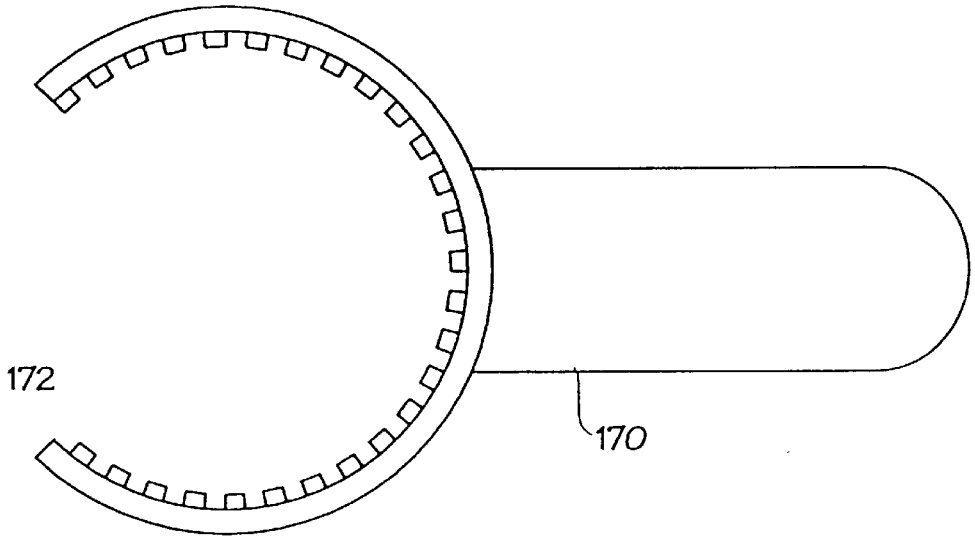
FIG. 10A is a plan view of a wrench which may be used for rotating the collar.
Figure 10B:
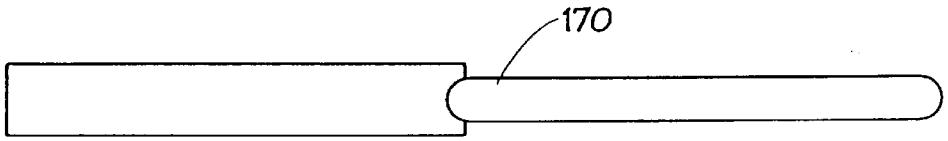
FIG. 10B is a side elevation of the wrench of FIG. 10A.
Figure 11:
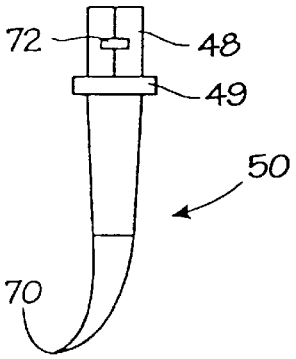
FIGS. 11–16, 17B, 18B and 19B are side elevational views (radially inward views with respect to how the teeth would appear in the sleeve) which illustrate a packing removal tooth and various tooth options for use with the present invention for performing both packing removal and cleaning operations.

The preferred tooth 50 for use with this invention tapers generally from the shoulder 49 below shank 48 to its point 70 and has a curvature constrained in a vertical plane, i.e. the plane of the page as shown in FIG. 11. The point 70 is sufficiently strong and sharp to enable easy penetration into the packing material. A transverse slot 72 is provided in the shank 48 in which a portion of the edge of the lower retaining ring 36 is receivable. The position of the slot 72 is such that when the shanks 48 of the teeth 50 have been inserted in their respective sockets 46 in sleeve 24 and retained therein by retaining ring 36, the teeth 50 curve in the same rotational direction. Since the lower retaining ring 36 is readily removable, the teeth 50 can also be readily removed and replaced with alternate teeth or other implements, such as those shown in FIGS. 8–15. These alternate implements will be described in more detail hereinbelow.

Details of the extractor collar 26 are shown in FIGS. 7A, 7B, 8 and 9 and operatively in FIG. 3. The collar 26 comprises two mating halves 52 connectable together, for example, by means of nut and bolt assemblies 54, 56 through mating apertures 58 in arms 60. A semi-circular recess 62 having a side wall 66 is provided at the lower end of each collar half 52. The side wall 66 has formed therein a semi-annular groove 68. A semi-cylindrical wall 64 is disposed generally coaxially with respect to the semi-circular recess 62 and extends from the recess 62 through to the upper end of the collar half 52. When the collar halves 52 are connected together, the semi-circular recesses 62 effectively form a circular recess 62' in the collar 26 and the semi-annular grooves 68 form an annular groove 68'. The semi-cylindrical walls 64, which are threaded, form a central aperture 64' adapted to engage the correspondingly threaded valve stem portion 17 as shown in FIG. 3.

The circular recess 62' has a diameter slightly greater than the diameter of the sleeve 24 diameter so as to enable the upper end of the sleeve 24 to be receivable therein. The depth of the circular recess 62' and the location of the annular groove 68' are such that the upper retaining ring 34 can be axially secured in the annular groove 68' in the side wall 66' of the circular recess 62' when the collar halves 52 are assembled about the split sleeve 24 and valve stem 16 and connected together as shown in FIG. 3. Since the aperture 64' of collar 26 threadingly engages the threaded portion 17 of valve stem 16, the collar 26, when rotated, translates axially along the valve stem 16. This arrangement enables the collar 26 to transmit to the sleeve an axially directed force while enabling the sleeve 24 to be freely rotated so that a rotational force can be applied to the sleeve independently of the axial force.

Due to the relative hardness of some packings and since somewhat large axial extraction forces may be necessary to remove the packing, it is preferable to employ a mechanical advantage or power assistance for rotating the collar 26. In FIGS. 10A and 10B, a wrench 170 having an interiorly splined recess 172 is provided which is adapted to engage a corresponding exteriorly splined extension 174 provided on the top 176 of the collar 26.

Figure 20A:
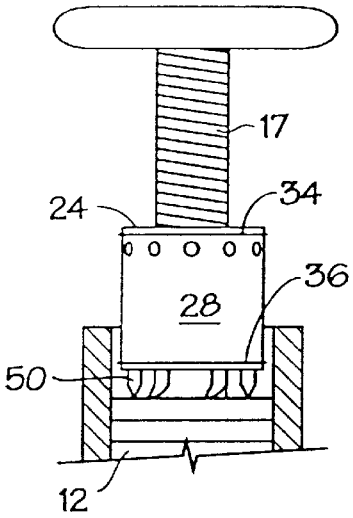
FIGS. 20A–20F are partial cross-sectional elevations illustrating the operation of the invention on a threaded valve stem.

The operation of the valve packing extractor 10 on a valve stem having a sufficiently threaded portion will now be described in conjunction with FIGS. 20A–20F. While the example shows a rising handle valve arrangement, where there is a sufficiently long threaded portion, the operation is the same for both rising handle and rising stem arrangements since no movement of the valve stem is necessitated. Teeth 50 are positioned in sleeve halves 28 ensuring the slots 72 of the shanks 48 (see FIG. 11) are positioned to receive the lower retaining ring 36. The sleeve halves 28 are then positioned around the valve stem 16, with the teeth 50 on the end of the sleeve 24 proximal the valve packing 12, and affixed in a cylindrical relationship with upper and lower retaining rings 34, 36 as shown in FIG. 20A.

Figure 20B:
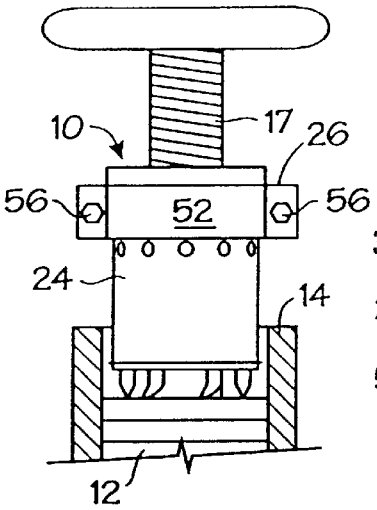

The collar halves 52 are then positioned about the valve stem 16 and the split sleeve 24, ensuring that the upper retaining ring 34 is fitted into the semi-annular groove 68 of each collar half 52 and that the threaded aperture 64' engages the threaded valve stem portion 17 in an appropriate manner before bolts 56 are tightened, as shown in FIG. 20B. The valve packing extractor 10 is now ready to be used to remove the packing 12 from the valve housing 14. Rotation of the collar 26 will cause a corresponding axial translation of the entire extractor 10 and hence the sleeve 24.

Figure 20C:
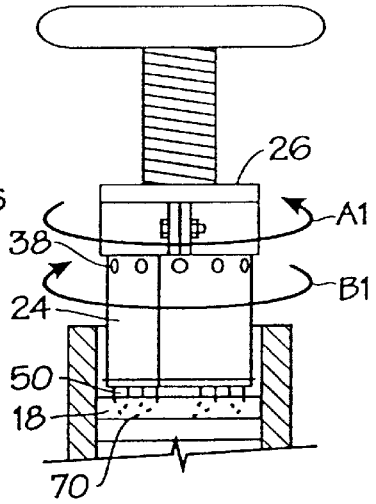

As illustrated in FIG. 20C, the collar 26 is rotated so as to cause the sleeve to translate toward the valve packing 12. It will be appreciated that the actual direction of rotation to cause such a movement will be dependent on the direction of the valve stem threads. In the example shown in the drawings, the valve stem has been given left-handed threads. Therefore, a counter-clockwise rotation of the collar 26, as seen from the top and as shown by arrow A1 in FIG. 20C, will result in the extractor 10 translating toward the first packing ring 18. Depending on where the teeth 50 are located in relation to the first packing ring 18 when the extractor assembly was completed, i.e. touching the first packing ring 18 or spaced above it, the collar 26 may need to be rotated in the direction of arrow A1 until the teeth 50 come into contact with the first packing ring 18. A slight further rotation in the A1 direction presses the tooth points 70 into piercing the packing material. The sleeve 24 is then rotated in the same direction as the direction that the teeth are curved, which in the drawings is clockwise as viewed from the top of the valve stem and as shown by arrow B1, by engaging the lug 40 of wrench 42 (not shown) in one of the wrench holes 38 in sleeve 24 and applying a torque. Due to the curvature of the teeth 50, the rotational force applied to the sleeve and the downward axial force applied to the sleeve 24 by the rotation of the collar 26, the teeth 50 penetrate the packing material and are embedded therein. Depending on the length of the teeth 50 and/or the extent to which the teeth 50 are embedded, it may be necessary to rotate the collar 26 further in the A1 direction to ensure it does not prevent or cause resistance to the natural corkscrew embedding motion of the toothed sleeve 24.

Figure 20D:
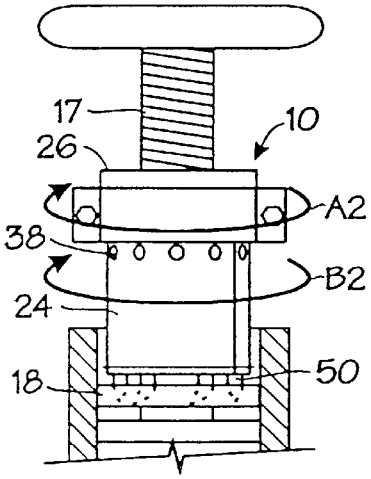

Once the teeth are embedded, the collar 26 is then oppositely rotated, i.e. in the direction of arrow A2 as shown in FIG. 20D, while continuing to maintain or apply further rotational force to the sleeve 24 as shown by arrow B2. The rotation of the collar 26 in the A2 direction causes the extractor 10 to translate in an axial direction along threaded valve stem portion 17 away from the packing 12 and, hence, to exert an axial extracting force on the sleeve 24 and, through teeth 50, on the first packing ring 18. The rotational force applied to or maintained on the-sleeve 24 in the B2 direction ensures that the teeth 50 do not back out of the packing ring 18 as the axial extracting force is applied, reduces the tendency of the curved teeth from tearing out of the packing material, and, if sufficient, serves to twist the packing ring 18 from its seating position which facilitates the removal of the ring 18 from the housing 14.

Figure 20E:
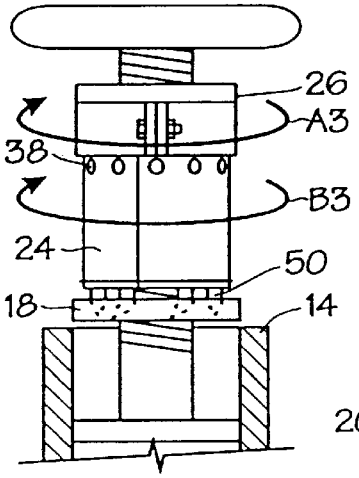
Figure 20F:
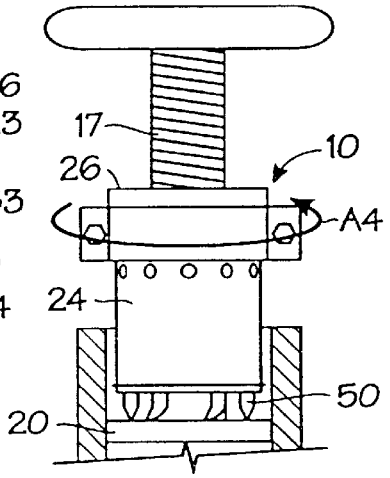

The rotation of the collar 26 and application of the rotational force on the sleeve 24 are continued as shown by arrows A3 and B3, respectively, in FIG. 20E, until the packing ring 18 is free of the housing 14. The packing ring 18 is then removed from teeth 50 and the valve packing extractor 10 is then translated back down threaded valve stem portion 16 by rotating the collar 26 in the direction of arrow A4 as shown in FIG. 20F until the teeth 50 come into contact with the next packing ring 20. The process is then repeated until all packing rings have been removed.

Figure 21A:
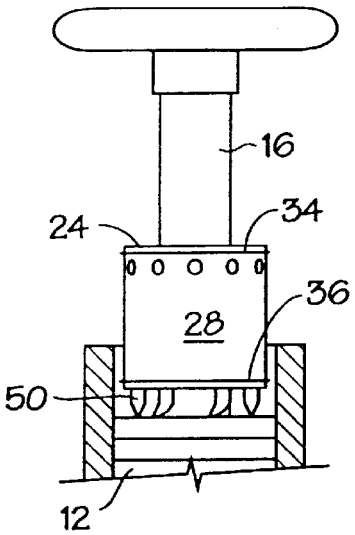
FIGS. 21A–21F are partial cross-sectional elevations illustrating the operation of the invention on a non-threaded rising valve stem.

The operation of the valve packing extractor 10 on a valve stem when the threaded portion of the valve stem is insufficient will now be described in conjunction with FIGS. 21A–21F. In this example, a rising stem valve stem arrangement (i.e. the valve stem translates but does not rotate) is shown, however, the apparatus will work on the rising handle type arrangements since the collar is rotatable independently of the sleeve. Teeth 50 are positioned in sleeve halves 28 ensuring the slots 72 of the shanks 48 (see FIG. 11) are positioned to receive the lower retaining ring 36. The sleeve halves 28 are then positioned around the valve stem 16, with the teeth 50 on the end of the sleeve 24 proximal the valve packing 12, and affixed in a cylindrical relationship with upper and lower retaining rings 34, 36 as shown in FIG. 21A.

Figure 21B:
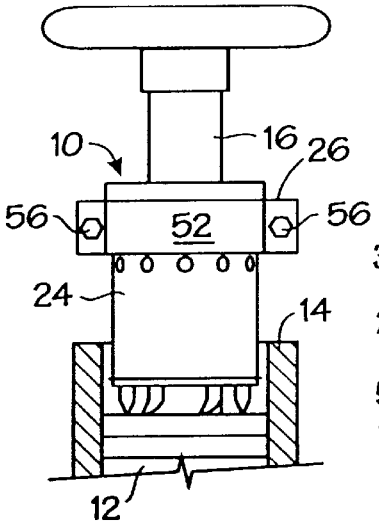

The collar halves 52 are then positioned about the valve stem 16 and the split sleeve 24, ensuring that the upper retaining ring 34 is fitted into the semi-annular groove 68 of each collar half 52. The collar is clamped directly onto the valve stem 16 and bolts 56 are tightened, as shown in FIG. 21B. The valve packing extractor 10 is now ready to be used to remove the packing 12 from the valve housing 14. Rotation of the valve handle 19 will cause a corresponding axial translation of the entire extractor 10 and hence the sleeve 24. In the case of a rising stem arrangement such as is shown, the collar 26 translates with the stem 16, neither of which rotate. In the case of a rising handle arrangement, both the valve stem 16 and the collar 26 would rotate during translation of the collar 26.

Figure 21C:
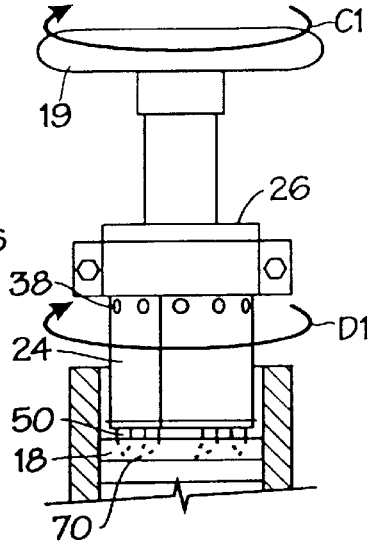

As illustrated in FIG. 21C, the handle 19 is rotated so as to cause the collar 26 and hence the sleeve 24 to translate toward the valve packing 12. It will be appreciated that the actual direction of rotation to cause such a movement will be dependent on the direction of the valve stem threads. In the example shown in the drawings, the clockwise rotation of the handle 19, as seen from the top and as shown by arrow C1 in FIG. 21C, results in the extractor 10 translating toward the first packing ring 18. Depending on where the teeth 50 are located in relation to the first packing ring 18 when the extractor assembly was completed, i.e. touching the first packing ring 18 or spaced above it, the handle 19 may need to be rotated in the direction of arrow C1 until the teeth 50 come into contact with the first packing ring 18. A slight further rotation in the C1 direction presses the tooth points 70 into piercing the packing material. The sleeve 24 is then rotated in the same direction as the direction that the teeth are curved, which in the drawings is clockwise as viewed from the top of the valve stem and as shown by arrow D1, by engaging the lug 40 of wrench 42 (not shown) in one of the wrench holes 38 in sleeve 24 and applying a torque. Due to the curvature of the teeth 50, the rotational force applied to the sleeve and the downward axial force applied to the sleeve 24 by the translation of the collar 26, the teeth 50 penetrate the packing material and are embedded therein.

Figure 21D:
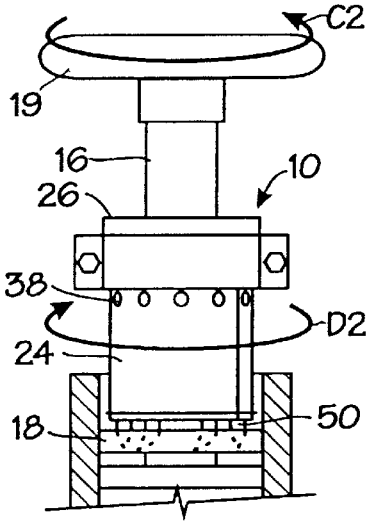

Once the teeth are embedded, the collar 26 is then oppositely translated, i.e. by rotating the handle 19 in the direction of arrow C2 as shown in FIG. 21D, while continuing to maintain or apply further rotational force to the sleeve 24 as shown by arrow D2. The rotation of the handle in the C2 direction causes the extractor 10 to translate in an axial direction away from the packing 12 and, hence, to exert an axial extracting force on the sleeve 24 and, through teeth 50, on the first packing ring 18. The rotational force applied to or maintained on the sleeve 24 in the D2 direction ensures that the teeth 50 do not back out of the packing ring 18 as the axial extracting force is applied, reduces the tendency of the curved teeth from tearing out of the packing material, and, if sufficient, serves to twist the packing ring 18 from its seating position which facilitates the removal of the ring 18 from the housing 14.

Figure 21E:
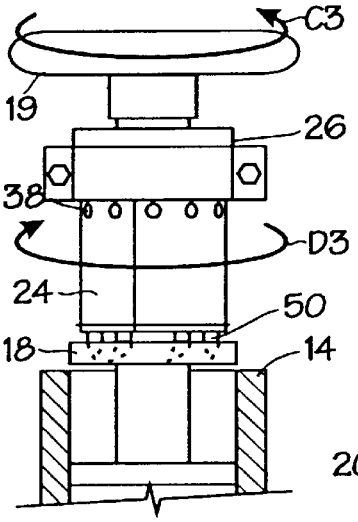
Figure 21F:
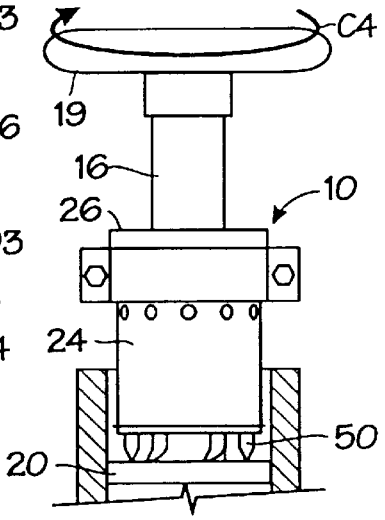

The rotation of the handle to translate the collar 26 and application of the rotational force on the sleeve 24 are continued as shown by arrows C3 and D3, respectively, in FIG. 21E, until the packing ring 18 is free of the housing 14. The packing ring 18 is then removed from teeth 50 and the valve packing extractor 10 is then translated back down threaded valve stem portion 16 by rotating the handle 19 in the direction of arrow C4 as shown in FIG. 21F until the teeth 50 come into contact with the next packing ring 20. The process is then repeated until all packing rings have been removed.

Figure 12:
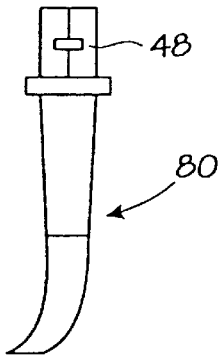
Figure 15:
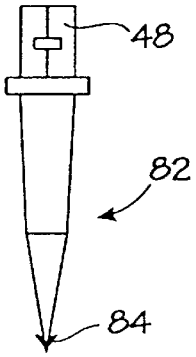
Figure 18A:
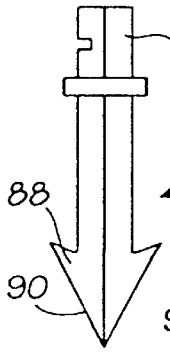
Figure 18B:
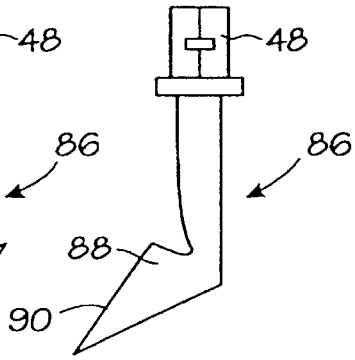
Figure 19A:
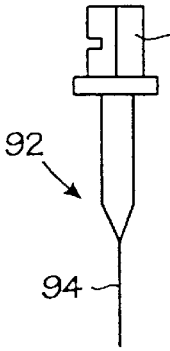
Figure 19B:
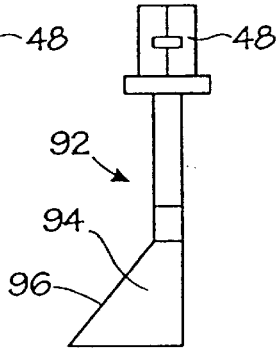

Although the present valve packing extractor 10 is better suited to removing valve packings than the prior art devices, problems can arise when the packing has hardened sufficiently that the teeth cannot penetrate the packing adequately or when the packing material has deteriorated so much that it does not provide sufficient resistance to prevent the penetrated teeth from ripping out of the packing when the axial extracting force is applied. In such cases, the pointed teeth 50 can readily be replaced by more appropriate teeth to suit the specific circumstance. FIG. 12 illustrates a chisel-tipped tooth 80 which when used can carve out the packing in pieces. FIG. 15 shows a wing-tipped tooth 82 which has a barbed, pointed end 84 which is used to penetrate directly into the packing material (i.e. no rotation of the sleeve 24). In this case, the collar 26 or the handle 19 is rotated to translate the sleeve axially so as to cause the barbed tip 84 to penetrate the packing. The collar 26 or the handle 19 is then rotated in the opposite direction to remove the packing ring. This type of tooth is advantageous for relatively soft packing materials. FIGS. 18A and 18B shows a cutting implement 86 having a sharp, shovel-like tip. The tooth 86 has a pair of flukes 88 each having a forwardly projecting edge 90 which is extremely sharp. The edges 90 slice into the packing and, as the sleeve 24 is rotated, the sliced portion of packing is lifted up by the flukes 88. FIGS. 19A and 19B illustrate yet another cutting tooth 92. Cutting tooth 92 has a thin, upright blade 94 with a sharp leading edge 96 which is used to slice the packing in two, resulting in several annular segments of packing which might be easier to remove in some circumstances.

Figure 13:
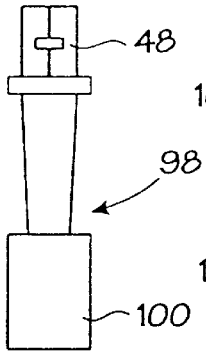
Figure 14:
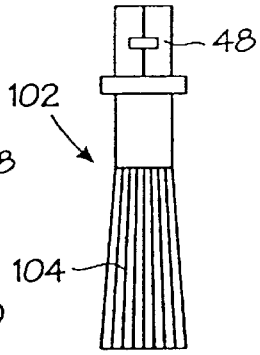
Figure 17A:
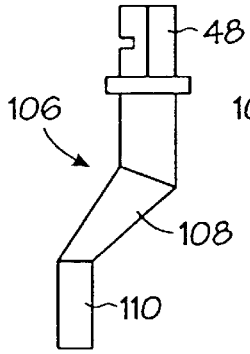
FIGS. 17A, 18A and 19A are front elevations (tangential views with respect to their placement in the sleeve) of the tooth implements of FIGS. 17B, 18B and 19B, respectively.
Figure 17B:
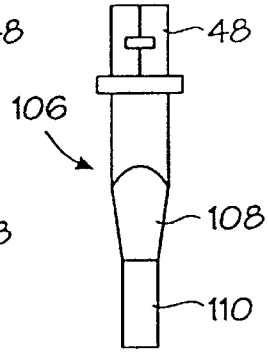

The present invention may also be used in the cleaning of the housing area once the packing rings have been removed. FIG. 13 illustrates a brush-tipped tooth 98 which can be used to clean the valve housing 14 once the packing has been removed to remove any debris or packing particles remaining after the extraction process. The tip 100 of this tooth comprises a roll of compressed material, such as felt. FIG. 14 shows a cleaning tooth 102 having a wire bristle tip 104. FIGS. 17A and 17B show another embodiment of a cleaning implement 106 having an offset portion 108 which allows the tip 110 to extend radially outwardly of the sleeve 24 to ensure contact with the inner walls of the housing 14. The tip 110 can be provided with a blade-type scraper for cleaning the walls of the housing 14 or with a cleaning device of the aforesaid type. Although, it is preferred that a sleeve of appropriate dimensions be chosen to suit the task at hand, i.e the sleeve 24 should have an outside diameter slightly less that the diameter of the valve packing housing 14, and an inside diameter greater than the diameter of the valve stem 16, by providing packing removal teeth, or cutting and cleaning implements with offsets, the useful outer diameter of the apparatus can be increased.

Any of these alternate teeth are easily substituted for the pointed teeth 50 since they can all be provided with common shank 48 and socket 46 combinations. It should be noted here that when using these alternate teeth it may not be necessary to employ the translatory capabilities of the collar 26, particularly when cleaning, although the collar 26 may be useful when a downwardly directed force is desired, such as when chiselling, or it may not be necessary to rotate the sleeve when an axial penetrating force only is desired, i.e. such as with the valve packing engagement tooth 82 shown in FIG. 11.

Figure 22:
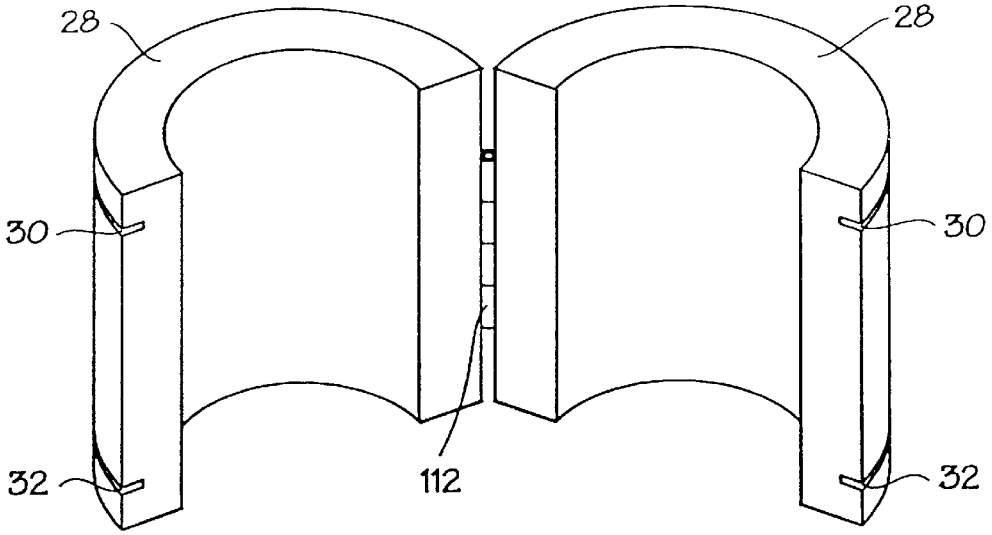
FIG. 22 is a perspective view of an alternate embodiment of the sleeve of the present invention.
Figure 23A:
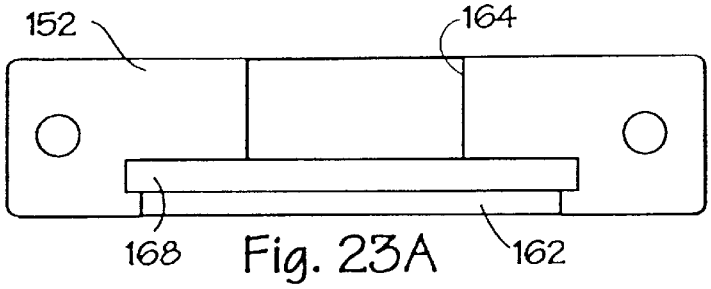
FIG. 23A is an elevational view of an alternate embodiment of the collar.
Figure 23B:
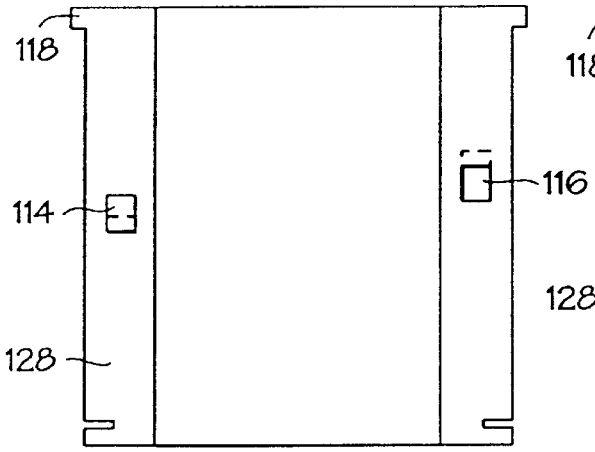
FIG. 23B an elevation of half of another alternate split sleeve illustrating different connection means for the sleeve halves and the collar.
Figure 23C:
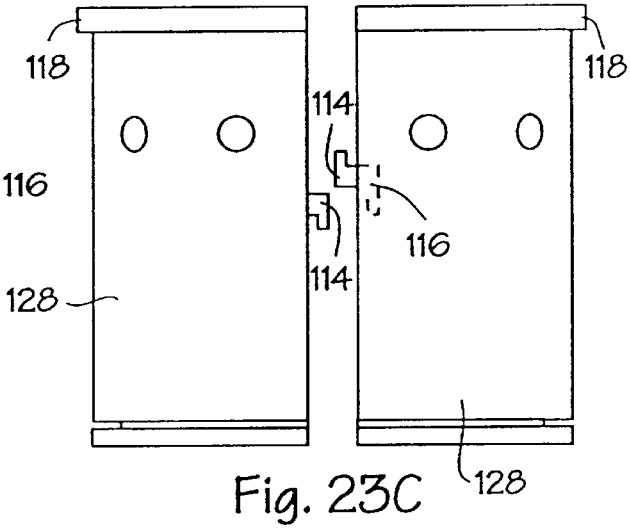
FIG. 23C is a side elevation showing the split sleeve half of FIG. 23B along side its mating half.

FIGS. 22 and 23B–C show alternate ways for joining the sleeve halves 28; FIG. 22 shows sleeve halves connected by means of a hinge 112. Such an arrangement keeps the two halves 28 together, especially when the halves are not matingly connected by rings 34,36 via slots 30,32.

FIGS. 23B and 23C show sleeve halves 128 each having an L-shaped latch 114 and a corresponding L-shaped recess 116 for the other half's latch 114. The halves are fitted together by first effecting a slight relative axial displacement to align the respective latch 114 with its corresponding recess 116, bringing the two halves 128 together such that each latch 114 is received in its respective recess 116 and then effecting an opposite relative axial displacement to lock the latches 114 in their recesses 116.

The sleeve halves 128 shown in FIGS. 23B and 23C are also provided with an alternate mechanism for rotationally engaging likewise modified collar halves 152 shown in FIG. 23A. The semi-cylindrical sleeves 128 are provided with a semi- annular flange 118 adapted to engage a corresponding semi-annular slot 168 in the semi-circular recess 162 in collar half 152. Obviously, the tolerances of the flange 118 and slot 168 are such to permi t the sleeve 24 to readily be rotated within the collar 26 but also to provide secure axial retention therein. The collar half 152 is also provided with a smooth semi-cylindrical wall 164 which can be used alternately to engage the smooth (i.e. non-threaded) portion of the valve stem. However, it is contemplated that a threaded collar could have an interior diameter which corresponds to the diameter of the non-threaded portion of the valve stem and could have a sufficiently smooth surface so as to not damage the valve stem when clamped thereon, such as is illustrated in FIG. 7A.

Figure 24:
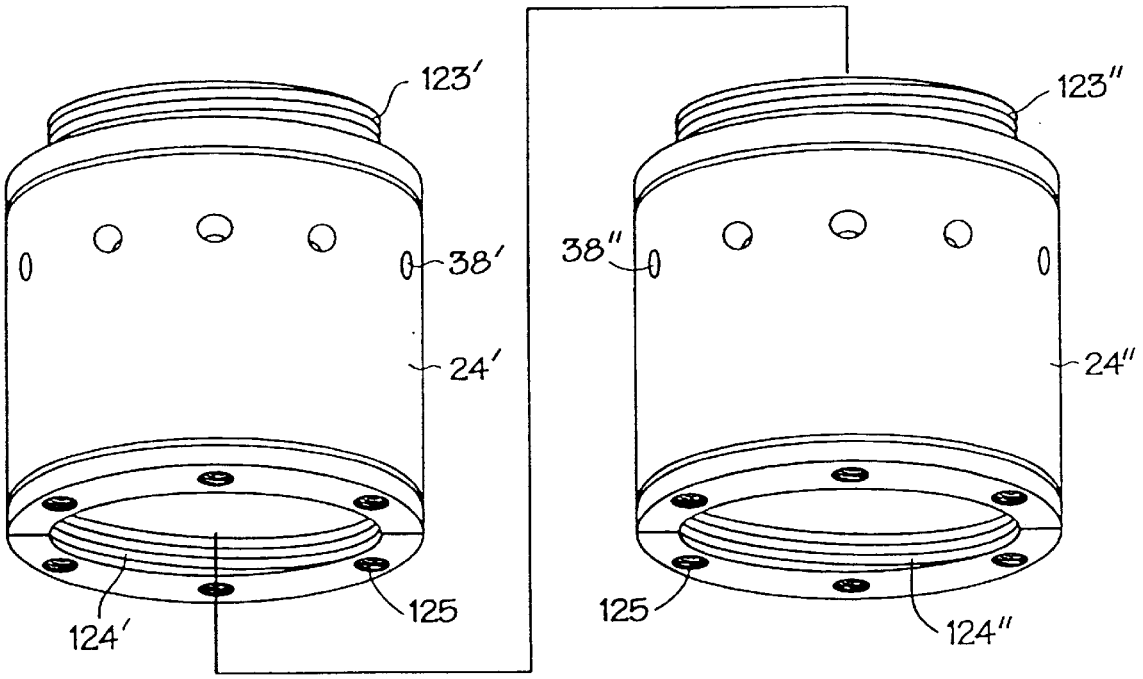
FIG. 24 is an oblique view illustrating the manner in which a number of modified sleeves can be coupled together to effectively increase the operational length of the apparatus.

In some valves, the packing housing 14 is relatively deep, accommodating numerous packing rings, and the height of the sleeve 24 may be insufficient to enable teeth 50 to engage deeper packing rings while still permitting access to the holes 38 for rotation of the sleeve 24. A slight modification to the sleeve 24 involving providing a threaded neck portion 123" on the upper end of the sleeve 24" with a correspondingly matingly threaded inner portion 124" at the lower end of sleeve 24", as shown in FIG. 24, results in a sleeve 24" which can be coupled with one or more similar sleeves 24' to effectively increase the operating length (or height) of the sleeve combination. The holes 38' of sleeve 24' may then be used to rotate the sleeve 24" when the holes 38" are no longer accessible. Although not shown, it will be obvious that the collar 26 may require some modification to accommodate the threaded portion 123' of the extension sleeve 24'. This is easily accomplished by providing a deeper circular recess 62 in collar 26.

Figure 16:
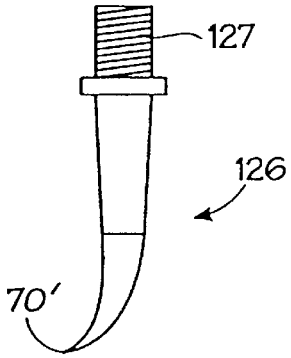

In the embodiment shown in FIG. 24, there are a series of threaded holes 125 provided in the bottom of each of the sleeves 24',24". These holes 125 provide an alternate means for attaching teeth or cutting implements to the sleeve. A tooth 126 having a correspondingly threaded shank 127 is shown in FIG. 16. The threads are cut such that when each tooth 126 is screwed into sleeve 24" and tightened, the tooth point 70' curves in the same rotational direction.

Figure 25:
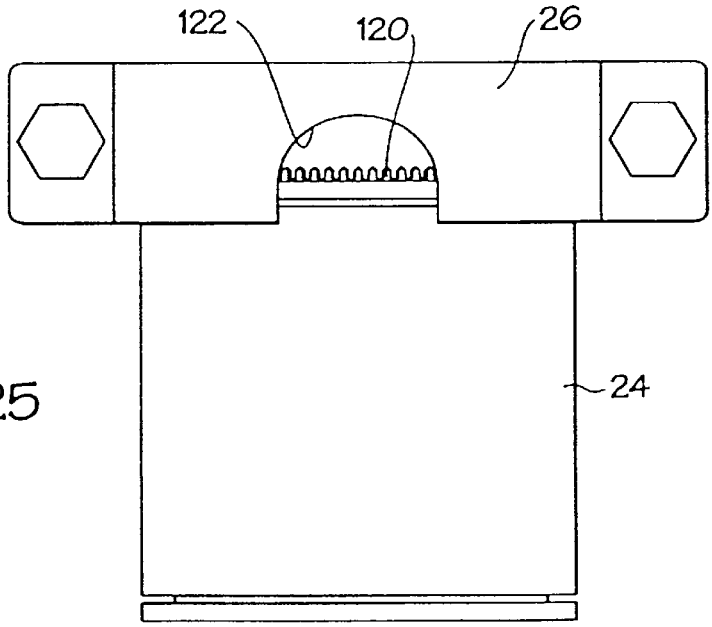
FIG. 25 is an elevational view of another embodiment of the collar and sleeve combination of the present invention.

As indicated above, rotation of the sleeve 24 is preferably provided by means of the wrench 42, shown in FIG. 4, whereby the lug 40 engages one of the plurality of holes 38 provided in the sleeve 24. The lever arm of the wrench 42 provides a mechanical advantage to assist with rotation and similarly with wrench 170. It will be appreciated, however, that a variety of devices designed to engage a cylindrical member to cause it to be rotated could be used with the present sleeve. Such devices include, but are not limited to, chain- or belt-type wrenches, pipe wrenches, and other vice-type wrenches. It is also contemplated that ratcheted or power-assisted devices could also be employed to effect rotation of the sleeve. In this latter regard, FIG. 25 illustrates a sleeve 24 having a series of gear teeth 120 disposed along its upper edge. A cut-out 122 is provided in the collar 26 to enable a small driving gear fitted on the end of a battery-operated or electric drill or screw-driver (not shown) to be engaged with the gear teeth 120 for rotation of the sleeve 24.

Figure 26B:
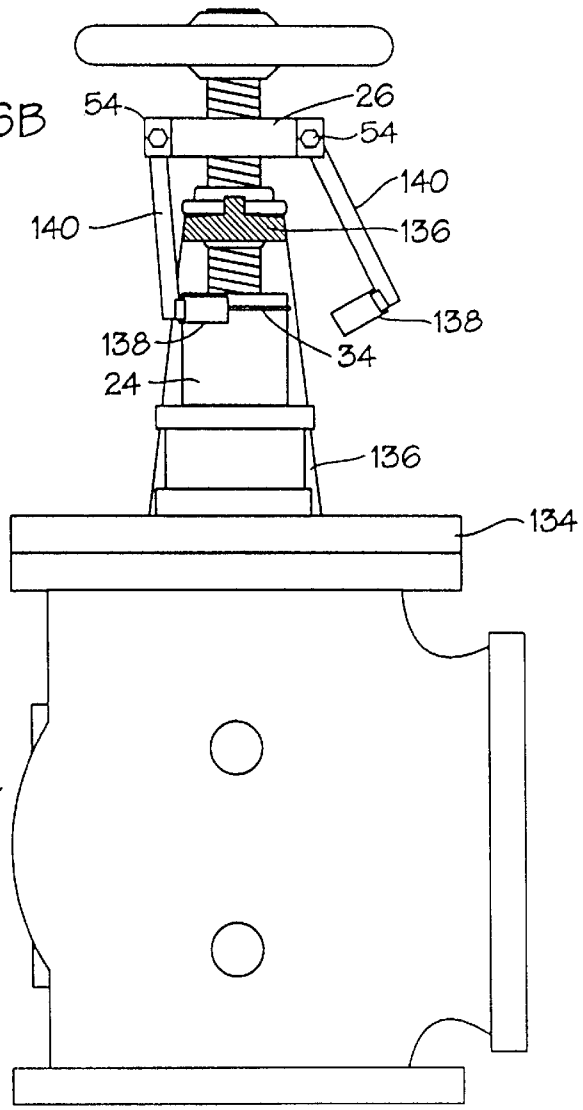
FIG. 26B is a front elevation of the embodiment and valve shown in FIG. 26A with one of the valve yoke struts partially broken away.
Figure 26A:
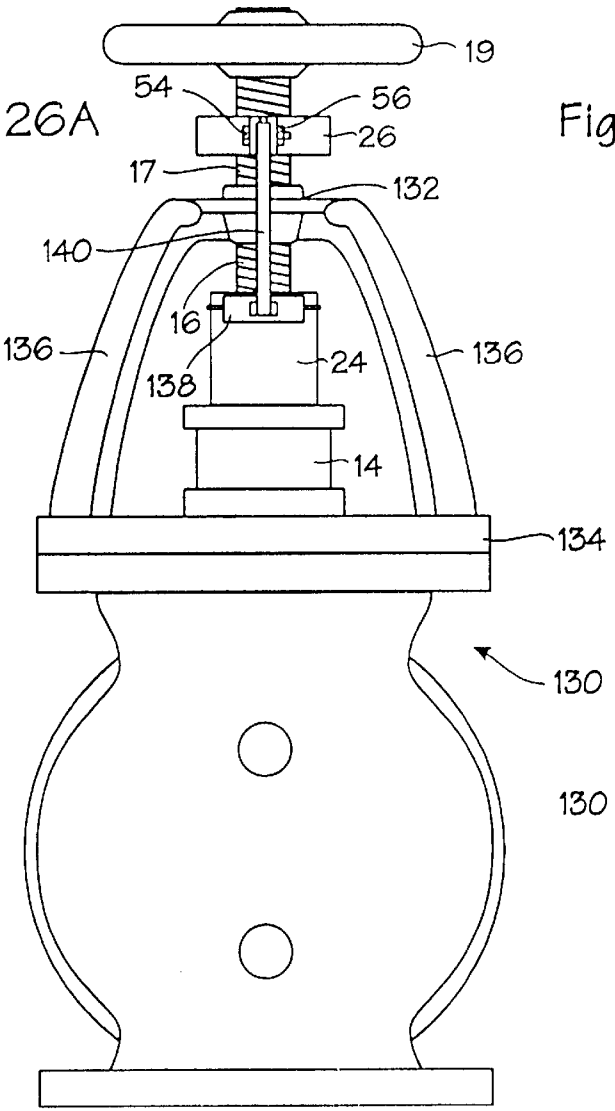
FIG. 26A is a side elevation of yet another embodiment of the invention used in conjunction with a short yoke valve.

In some cases and especially in the case of short yoke valves, the valve yoke inhibits or prevents proper operation of the extractor device. The subject invention is readily adaptable to such a situation. A short yoke valve 130 is shown in FIGS. 26A and 26B which has a valve yoke 132 which extends up from the valve housing 134 via valve yoke struts 136 and engages and supports the threaded portion 17 of the valve stem. The toothed sleeve 24 is assembled as described above and placed about the valve stem and within packing housing 14. In this case, the extractor collar 26 can be articulated around valve yoke 132 to sleeve 24 and is engaged with the threaded portion 17 of the valve stem above the valve yoke 132 and below the valve handle 19. A pair of C-shaped supports 138 are articulated to the extractor collar 26 by way of arms 140, which are pivotable about bolt and nut assemblies 54,56. The C-shaped supports 138 have internal grooves (not shown) which engage the upper retaining ring 34 located on sleeve 24 to enable the translation motion of the extractor collar when rotated to be transferred to the sleeve 24.

In summary, there has been described and illustrated herein various embodiments of the valve packing extractor according to the invention. These embodiments are not intended to be limiting but rather illustrative of the features of the invention and it will be appreciated that various modifications and adaptations of the elements may be made without departing from the spirit and scope of the claims as defined in the appended claims.

I claim:

1. An apparatus for removing a valve packing from around a valve stem of a valve, the apparatus comprising:

a split sleeve positionable generally concentrically about the valve stem, a collar comprising two connectable collar halves having an aperture defined between said collar halves for engaging a portion of the valve stem when said collar halves are connected, said collar being attachable to a portion of said valve stem by connecting said collar halves about the valve stem;

said split sleeve having disposed on an end thereof a plurality of packing engagement teeth, said teeth all being curved in a same rotational direction; and said split sleeve being rotatably connected to said collar for independent rotation with respect thereto.

2. An apparatus as claimed in claim 1, wherein said split sleeve comprises a pair of mating semi-cylindrical halves which are securable together to form said sleeve.

3. An apparatus as claimed in claim 2, wherein said sleeve halves are retained together by one or more retaining rings which fit into corresponding grooves provided in said halves.

4. An apparatus as claimed in claim 3, wherein said sleeve halves are hinged together by hinge means disposed generally parallel to a longitudinal axis of the sleeve.

5. An apparatus as claimed in claim 3, wherein said collar includes a circular recess into which said sleeve is adapted to be rotatably received, said recess having an annular groove in a sidewall for engaging one of said retaining rings which hold said sleeve halves together to prevent relative axial movement between said sleeve and said collar but to permit relative rotation therebetween.

6. An apparatus as claimed in claim 3, wherein said collar connects to said sleeve rotatably by articulated means comprising a pair of arms pivotally connected to said collar, each said arm including a C-shaped support engageable on opposed sides of said sleeve with one of said retaining rings, whereby axial translation of said collar by its rotation causes said sleeve to also be translated and wherein said sleeve remains freely rotatable between said C-shaped supports.

7. An apparatus as claimed in claim 3, wherein said plurality of teeth each have a cross-sectionally square shank and said sleeve has a corresponding plurality of square holes in which said teeth are retainable.

8. An apparatus as claimed in claim 4, wherein at least one of said corresponding grooves for said retaining rings partially intersects said square holes in said sleeve and wherein said cross-sectionally square shanks of said teeth have a corresponding groove such that when said shanks are fitted into said square holes at least one of said retaining ring engages said groove on said shank to retain said teeth within said square holes.

9. An apparatus as claimed in claim 1, wherein said teeth have threaded shanks, said shanks being threadable into corresponding threaded holes in said sleeve in such a manner that when tightened, said teeth all curve in the same rotational direction.

10. An apparatus as claimed in claim 1, wherein said collar includes fasteners for connecting said collar halves together clampingly about said portion of said valve stem.

11. An apparatus as claimed in claim 1, wherein said collar includes a circular recess into which said sleeve is adapted to be rotatably received, said recess having an annular groove in a sidewall for engaging an annular flange provided on said sleeve to prevent relative axial movement between said sleeve and said collar but to permit relative rotation therebetween.

12. An apparatus as claimed in claim 1, further including means for rotating said sleeve.

13. A valve packing extracting apparatus in combination with a valve having a valve handle which is rotatable to axially translate said valve stem, and having valve packing disposed generally within a valve packing housing through which a valve stem extends, said valve stem having a portion extending exteriorly of said packing and said valve packing housing, said valve packing extracting apparatus comprising:

a sleeve positionable about the valve stem;

a collar comprising two connectable collar halves having an aperture defined between said collar halves for engaging a portion of the valve stem when said collar halves are connected in clamping relation on said portion of said valve system, whereby said collar is translatable towards and away from said valve packing by rotation of said valve handle;

said sleeve being rotatably connected to said collar for independent rotation with respect thereto; and a plurality of curved teeth connectable to an end of said sleeve proximal to said valve packing, said plurality of teeth all being connected to said sleeve such that they curve in a same rotational direction to enable said teeth to penetrate and embed into said valve packing when said sleeve is rotated in said same rotational direction while being translated in a first axial direction toward said valve packing by rotation of said valve handle, and to enable said teeth to remain embedded in said valve packing when said valve handle is rotated in the opposite direction to cause said sleeve to be translated in an axial direction opposite said first axial direction while said sleeve is continued to be rotated in said same rotational direction to thereby remove from said valve packing housing said valve packing in which said teeth are embedded.

14. An apparatus as claimed in claim 13, wherein said sleeve comprises a pair of mating semi-cylindrical halves which are securable together to form said sleeve.

15. An apparatus as claimed in claim 14, wherein said sleeve halves are retained together by one or more retaining rings which fit into corresponding grooves provided in said halves.

16. An apparatus as claimed in claim 15, wherein said plurality of teeth each have a cross-sectionally square shank and said sleeve has a corresponding plurality of square holes in which said teeth are retainable.

17. An apparatus as claimed in claim 16, wherein at least one of said corresponding grooves for said retaining rings partially intersects said square holes in said sleeve and wherein said cross-sectionally square shanks of said teeth have a corresponding groove such that when said shanks are fitted into said square holes at least one of said retaining ring engages said groove on said shank to retain said teeth within said square holes.

18. An apparatus as claimed in claim 13, wherein said teeth have threaded shanks, said shanks being threadable into corresponding threaded holes in said sleeve in such a manner that when tightened, said teeth all curve in the same rotational direction.

19. An apparatus as claimed in claim 13, wherein said aperture has a shape and configuration which conforms substantially with said portion of said valve stem to which said collar is clamped.

20. An apparatus as claimed in claim 13, further including means for rotating said sleeve.

21. An apparatus as claimed in claim 20, wherein said means for rotating said sleeve comprises a wrench having a lug adapted to engage one of a plurality of radial holes provided in said sleeve.

22. An apparatus as claimed in claim 20, wherein said means for rotating said sleeve comprises a powered driving gear engageable with corresponding driven gearing provided on said sleeve.

23. An apparatus as claimed in claim 13, wherein said sleeve is provided with coupling means for coupling one or more additional sleeves thereto for increasing the operational length of said sleeve, wherein said teeth are disposed in the sleeve proximal the valve packing and said collar is rotatably connected to the sleeve which is distal the valve packing.

24. An apparatus as claimed in claim 13, wherein said portion of said valve stem has a diameter and wherein said aperture has a diameter which corresponds substantially with said diameter of said portion of said valve stem.

25. A valve packing removal and cleaning apparatus for use in combination with a valve having a valve packing disposed inside a valve packing housing and around a valve stem and having a valve handle which is rotatable to axially translate said valve stem, said valve stem extending exteriorly of said valve packing housing, said valve packing removal and cleaning apparatus comprising:

a collar clampable on a portion of said valve stem which extends exteriorly of said valve packing housing, said collar comprising mating collar halves having an aperture defined therebetween and means for connecting the collar halves together such that said portion of said valve stem is clamped in said aperture therebetween, said collar being axially translatable towards and away from said valve packing by rotation of said valve handle;

a sleeve positionable generally concentrically about the valve stem, said sleeve being rotatably connected to said collar for independent rotation with respect thereto;

a plurality of valve packing engagement teeth, valve packing cutting implements and valve packing housing cleaning implements for selective attachment to an end of said sleeve; and means for rotating said sleeve.

26. An apparatus as claimed in claim 25, wherein said valve packing engagement teeth comprise pointed teeth, all of which curve in a same rotational direction with respect to the sleeve to enable said teeth to penetrate and embed into said valve packing when said sleeve is rotated in said same rotational direction while said collar is translated towards said valve packing, and to enable said teeth to remain embedded in said valve packing when said collar is translated in an opposite direction while said sleeve is continued to be rotated in said same rotational direction thereby enabling said valve packing to be removed.

27. An apparatus as claimed in claim 25, wherein said valve packing engagement teeth comprise pointed teeth, each of which have a barbed end, said teeth being capable of penetrating and embedding into said valve packing when said valve handle is rotated to cause said collar and said sleeve to translate towards said valve packing, and further being capable of remaining embedded in said valve packing when said valve handle is rotated in the opposite direction to cause said collar to translate in an opposite direction thereby enabling said valve packing to be removed.

28. An apparatus as claimed in claim 25, wherein said valve packing cutting implements have cutting edges capable of cutting into said valve packing when said sleeve is rotated in a first rotational direction while said valve handle is rotated to cause said collar and said sleeve to translate towards said valve packing.

29. An apparatus as claimed in claim 28, wherein said valve cutting implements include a chisel tip for cutting and gouging out pieces of said valve packing when said sleeve is rotated.

30. An apparatus as claimed in claim 28, wherein said valve cutting implements include an upright blade with a sharp leading edge for cutting said valve packing into annular segments when said sleeve is rotated.

31. An apparatus as claimed in claim 28, wherein said valve cutting implements include a pointed shovel tip for cutting and uplifting pieces of said valve packing when said sleeve is rotated.

32. An apparatus as claimed in claim 25, wherein said valve packing housing cleaning implements include a brush capable of brushing any valve packing particles out of the valve packing housing when said sleeve is rotated.

33. An apparatus as claimed in claim 25, wherein said valve packing housing cleaning implements include a scraper capable of scraping the sides of the valve packing housing when said sleeve is rotated to remove any pieces of valve packing which might remain adhered thereon.

34. A packing removal apparatus for removing a packing from a packing housing surrounding a stem which is axially movable through said packing, the apparatus comprising:

a split sleeve positionable generally concentrically about the stem, a collar clampable on a portion of said stem, said collar comprising mating collar halves having an aperture defined therebetween and means for connecting the collar halves together such that said portion of said stem is clamped in said aperture;

said split sleeve having disposed on an end thereof a plurality of packing engagement teeth, said teeth all being curved in a same rotational direction; and said split sleeve being rotatably connected to said collar for independent rotation with respect thereto.

* * * * *